United States Patent [19]

Albano et al.

[11] 4,007,670

[45] Feb. 15, 1977

[54] INSULATED CONTAINER

[75] Inventors: John V. Albano, Oradell; Donald F. Smith, Clifton, both of N.J.

[73] Assignee: St. Regis Paper Company, New York, N.Y.

[22] Filed: Feb. 14, 1975

[21] Appl. No.: 549,979

Related U.S. Application Data

[62] Division of Ser. No. 446,703, Feb. 28, 1974, abandoned.

[52] U.S. Cl. ..... 93/36.01; 93/39 C

[51] Int. Cl.[2] ..... B31B 7/74

[58] Field of Search ..... 93/39 C, 36.2, 39.1 R, 93/39.2, 39.3, 36.01, 36 R, 36 M, 55.1 R, 55.1 M, 44.1 R, 36.3; 206/DIG. 11, 65 K, 65 R; 220/9; 229/14 BE, 14 H; 53/175; 156/287

[56] References Cited

UNITED STATES PATENTS

| | | | |
|---|---|---|---|
| 2,369,013 | 2/1945 | Braloff | 93/36.01 X |
| 2,395,754 | 2/1946 | O'Neil et al. | 93/39.1 R |
| 2,675,954 | 4/1954 | Vogel | 229/1.5 B X |
| 3,372,830 | 3/1968 | Edwards | 93/36.01 UX |
| 3,602,690 | 8/1971 | Rosenberg et al. | 93/55.1 R X |
| 3,797,369 | 3/1974 | Amberg | 93/36.01 |
| 3,908,523 | 9/1975 | Shikaya | 93/36.01 |

*Primary Examiner*—James F. Coan
*Attorney, Agent, or Firm*—Woodling, Krost, Granger & Rust

[57] ABSTRACT

The present disclosure relates to an insulated container construction and describes more specifically an embodiment of such construction which is in the nature of a disposable hot drink cup which includes an outer member shaped generally as a frustum of a cone having an open upper end and a closed bottom end and constructed of a paper material which preferably has a thickness in the range of from about 0.305 mm. to 0.457 mm. The container construction, also, includes an inner member shaped generally as a frustum of a cone and having an open upper end and a closed bottom end and residing within the above referred to outer member. The inner member is constructed of a synthetic resin or plastic material and preferably polystyrene and preferably of a thickness in the range of from about 0.127 mm. to 0.381 mm. The open upper end of the plastic inner member is turned outwardly and back upon itself to form a lip portion which engages the lips of a user of the cup and keeps the lips of the user of the cup away from the upper edge of the paper construction of the outer member. Wall means are provided on one or both of the outer and inner members to define an insulating air space between the two members to give the container construction a high insulation value. With this particular structure the paper outer member provides the primary support structure and the plastic inner member serves the primary function of holding the liquid which is to be carried by the container. Since the liquid is carried by the plastic inner member, it is not necessary to leakproof the paper material of the outer member. The wall means which define the insulating air space form preferably a triangular-appearing shape in cross section as viewed in an axial direction of the container.

7 Claims, 11 Drawing Figures

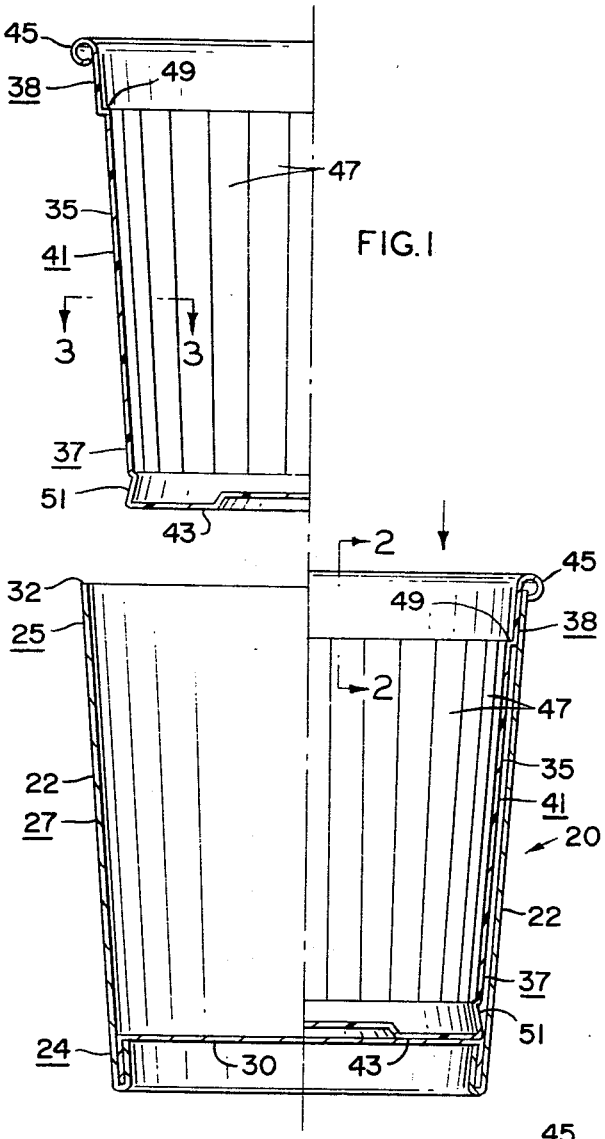
FIG. 1
FIG. 4A
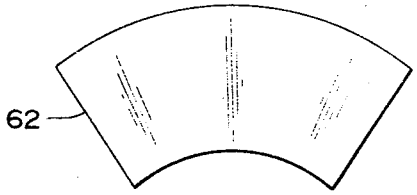
FIG. 4B
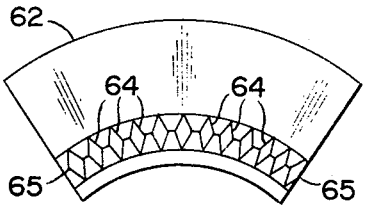
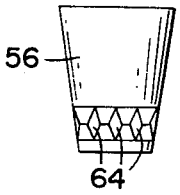
FIG. 4C
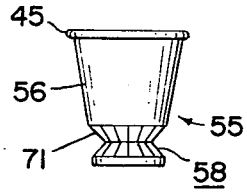
FIG. 4D
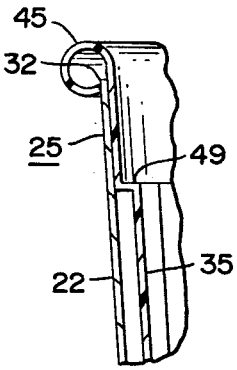
FIG. 2
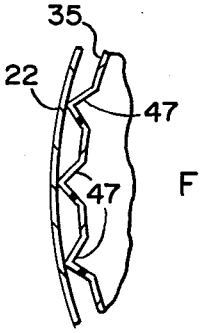
FIG. 3
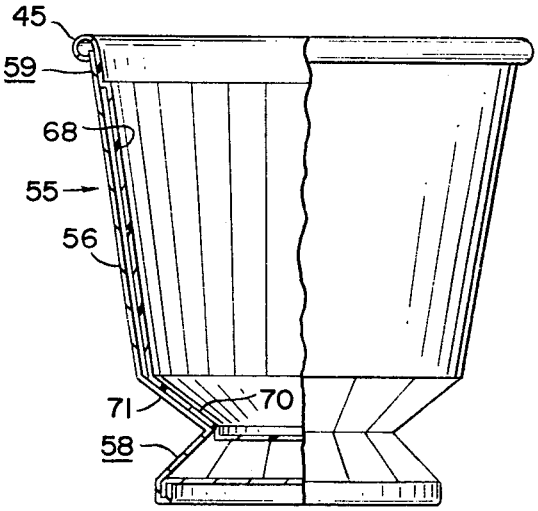
FIG. 4

INSULATED CONTAINER

This is a division of application Ser. No. 446,703, filed Feb. 28, 1974, and now abandoned.

The present invention also illustrates a modified form of the container which includes a plurality of circumferentially-spaced cut outs in the paper outer member, which permits the paper outer member to be radially collapsed at these cut outs to provide a pedestal-shaped support engaing portion for the container. The cut outs are preferably diamond shaped with the longer dimension of the diamond extending generally in an axial direction of the container and with the shorter dimension of the diamond extending in a circumferential direction of the container.

There is also disclosed the method or process of manufacturing the two container constructions referred to above.

It will be appreciated by those skilled in the art that many constructions have been manufactured and sold to the consuming public for the purpose of containing food and drink, for example, coffee, which containers are thrown away after use. A popular construction is simply a waxed or plastic coated paperboard container or a synthetic resin or plastic container. There are advantages and disadvantages in these constructions, and referring specifically to the paperboard construction, it will be appreciated that the paper must be adequately waterproofed or it will not satisfactorily contain and hold materials like hot coffee and the like. The paperboard-type construction is highly desirable from the standpoint that it is easy to print attractive designs on the surface thereof as well as advertising messages. The insulating qualities of these constructions are reasonably good; however, in the use of extremely hot beverages it is sometimes difficult to handle such constructions.

On the other hand, the plastic-type constructions such as expanded or foamed polystyrene are more desirable than the paperboard constructions in that they provide a more leak-proof construction without additional steps being taken and they naturally have a better insulating value. These constructions are, however, more difficult to apply designs and advertising messages to and have a poor appearance. The foamed plastics at times have an odor and/or bad taste and normally are structurally weak. With the exception of the foamed materials, plastics normally have poor insulating qualities. The plastic-type constructions are normally more desirable than the paperboard-type constructions in the feel on ones lips, for example, when drinking coffee out of such a cup.

It is, therefore, an object of the present invention to combine in a desirable and economically efficient manner the good characteristics of both the paperboard and plastic-type container designs so that the advantages of each structure can be readily obtained while the disadvantages of the structure can be offset or rendered unimportant so far as the entire container construction is concerned.

In this disclosure the container will be conveniently described as a cup to hold hot coffee; however, other uses will immediately come to mind. The insulating value of the container can, of course, be used for holding cold products. The present invention utilizes the theory of the combination of an outer hollow member of paperboard construction which is utilized for its structural values in order to support the remainder of the structure and also utilizes the advantages of the paperboard for receiving designs and advertising messages in an economical way and the construction utilizes an inner synthetic plastic material construction for the inner hollow member which has less desirable structural characteristics than the paperboard, but which has the advantage of being leakproof for the purpose of holding the contents of the container. The upper end of the synthetic plastic inner member is provided with a lip portion which extends from the open upper end of the inner member and is turned outwardly, downwardly and back in towards itself so that this portion is the portion of the container to engage the user's lips and which has a better "feel" than the paperboard construction of the outer member. In this cup construction it is not at all necessary to leakproof the outer paperboard container since it in no way functions to hold the liquid carried by the cup.

Excellent insulating qualities are imparted to the construction by the provision of providing wall means between the inner and outer hollow members. In the preferred embodiment, as shown, there are provided a plurality of circumferentially-spaced, axially-extending V-shaped ribs on the outer surface of the inner hollow member which extend out to the inner surface of the outer paperboard member so as to provide a series of axially extending chambers which contain dead air, which has a very high insulating value. In other words, in looking at these chambers in the axial direction of the container one observes a group of chambers which are generally trapezoidal in configuration.

In a modification of the invention, there is illustrated a design which enables the above referred to cup construction to be converted to what will be referred to as a mug-shape or a pedestal-shape. This is accomplished by providing the paperboard outer hollow member at its lower end portion with a plurality of circumferentially spaced, diamond-shaped cut outs. The diamond-shaped cut outs have a long dimension which extends in the axial direction of the member and a shorter dimension which extends in the circumferential direction of the member. In this embodiment the outer paperboard member is collapsed in a radial direction at the shorter dimension of the diamond shapes and this provides a unique appearing structure. The container is maintained in its collapsed condition by gluing or otherwise securing the inner synthetic plastic hollow member to a collapsed portion of the outer hollow paperboard member.

Other objects and a fuller understanding of this invention may be had by referring to the following description and claims, taken in conjunction with the accompanying drawings, in which:

FIG. 1 is a side elevational view partially in section illustrating the insulated container construction of the present invention;

FIG. 2 is an enlarged view taken generally along the line 2—2 of FIG. 1;

FIG. 3 is an enlarged view taken generally along the line 3—3 of FIG. 1;

FIG. 4 is an elevational view partly in section of a modified form of the container construction of the present invention;

FIG. 4A through 4D illustrates schematically the steps involved in making the cup of FIG. 4 starting with a flat paper blank as shown in FIG. 4A;

Figure 5:
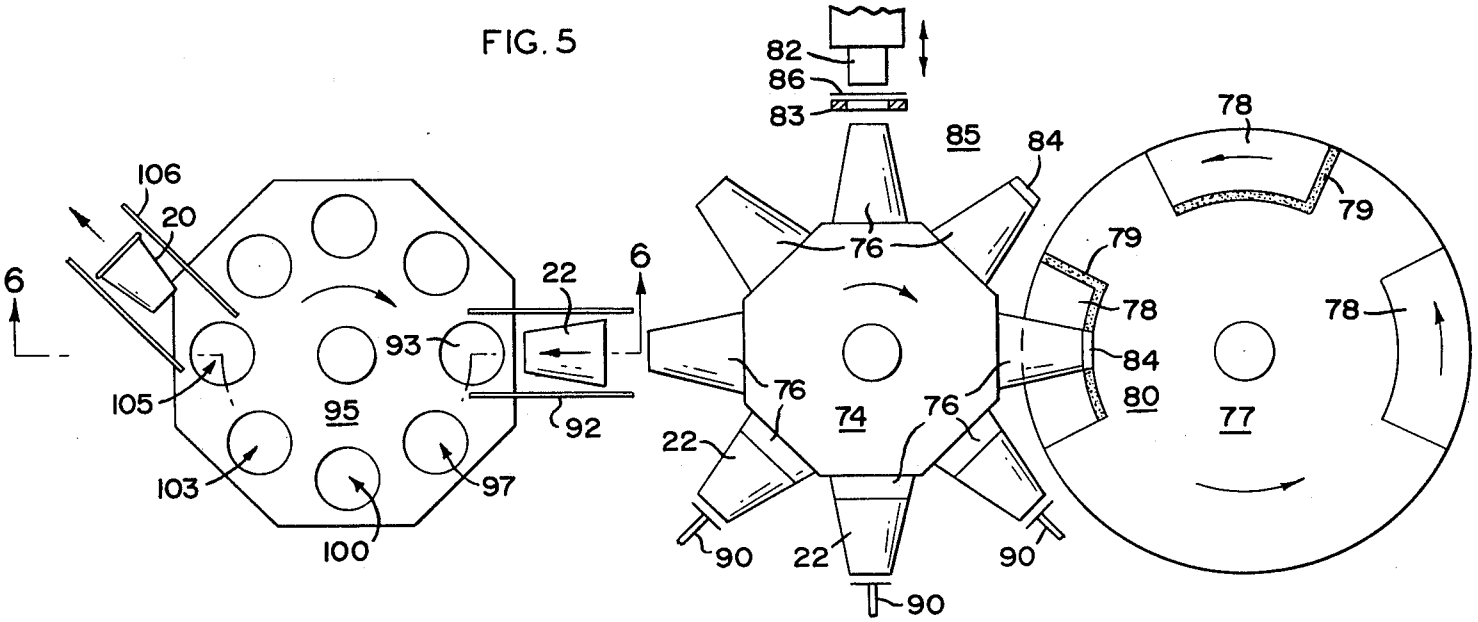
FIG. 5 is a plan view of an apparatus used in making the cup shown in FIGS. 1 through 3.

FIGS. 1 through 3 show one preferred embodiment of the cup of the present invention which has been indicated generally by the reference numeral 20. This cup includes a first outer hollow member 22 having first and second end portions 24 and 25, respectively, and an intermediate portion 27 located therebetween. A bottom wall 30 closes the first end portion or lower end portion 24 of the hollow member 22 and the second end portion of the hollow member 22 terminates in what will be referred to as a substantially straight edge 32 which defines a substantially circular opening into the first outer hollow member 22. It will be noted from FIG. 1 that this hollow member is formed so as to define essentially the frustum of a cone.

This first outer hollow member 22 is preferably constructed of what will be referred to as a paperboard construction which has a preferred thickness in the range of from about 0.305 mm. to 0.457 mm. This paperboard construction may be made from bleached, semi-bleached or natural kraft board which are all commercially available. It has been found that a paperboard manufactured by St. Regis Paper Company and identified as a bleached stock of approximately 0.308 mm. thickness provides excellent functional and cost characteristics.

A second inner hollow member 35 is provided which has first and second end portions 37 and 38, respectively, and an intermediate portion 41 therebetween. A bottom wall 43 closes the first end portion of the hollow member 35 and the second end portion or upper end portion of the inner hollow member 35 terminates in a lip 45. As will be noted, particularly from FIG. 2, this lip is formed by rolling the edge over upon itself or in other words, the material of the top edge can be said to be turned outwardly and back towards itself through approximately 360°. It will be noted that the material is turned back upon itself and terminates closely adjacent the top edge 32 of hollow member 22. It will be seen that wall means 47 are provided on the wall of member 35, which serve to define a plurality of axially extending and circumferentially spaced V-shaped ribs, which engage the inner wall of the hollow member 22 and serve to define a plurality of dead air spaces between the hollow members 22 and 35. These dead air spaces are generally trapezoidal in configuration. A shoulder 49 is provided at the second end portion 38 of hollow member 35 which provides for close engagement, from this point to the top of the container, between the hollow members and which construction serves to close off the top portions of the trapezoidal-shaped chambers. A step 51 is provided in the wall of the hollow member 35 at the first end portion 37 and this is designed primarily for ease in de-colating.

The second inner hollow member 35 is preformed in a separate manufacturing operation, for example by vacuum forming or by injection molding; and the material of construction of this hollow member is preferably a polystyrene plastic material. It is possible that other synthetic plastics may be utilized, for example an acrylonitrile or a polyethylene; however, it is preferred that the construction be polystyrene. It is, also, preferred that the polystyrene plastic material have a thickness in the range of from about 0.127 mm. to about 0.381 mm.

The inner and outer hollow members 22 and 35 are preferably maintained in their assembled condition by the application of an adhesive such as glue being applied to the surfaces between the two. It is preferred that the adhesive be applied to the inner surface of the outer hollow member 22 from the shoulder 49 to the top edge 32.

FIG. 4 illustrates a modification of the cup which is illustrated in FIGS. 1 through 3. This cup is identified by number 55. In those instances where the structure is the same as in the embodiment of FIGS. 1 through 3 the same reference numerals will be used to identify the structure. Different reference numerals will be utilized simply to describe a change in the structure. In this embodiment there is provided a first outer hollow member 56 which is provided with first and second end portions 58 and 59, respectively. The outer hollow member, before it is formed into its frustro-conical shape, is best seen in FIG. 4A which shows the paperboard blank 62 before it has been formed. It will be noted in FIG. 4B that a pattern of what will be referred to as diamond-shaped cut outs 64 are provided. The cut outs 64 are made simply by die cutting. It will be noted in FIG. 4B that the diamonds have a long dimension and a short dimension and the long dimension of the diamond extends in the axial direction of the member 56 and the short dimension of the diamond extends in the circumferential direction of member 56. The blank is preferably weakened or bent along a line 65 which extends through the short dimension of the diamonds. The blank 62 is simply assembled to its frustro-conical shape as seen in FIG. 4C being secured by glue and it is only then necessary to collapse the first end portion 58 of the hollow member 56 in what will be referred to as a radial direction and at the shorter dimension of the diamond-shaped cut outs to produce a configuration as seen in FIG. 4D as well as in FIG. 4. The second inner hollow member which is essentially the same as the member 35 shown in FIGS. 1 through 3 has here been identified by the reference numeral 68 simply because of the configuration of the first end portion thereof. The configuration of the first end portion 70 is shown best in FIG. 4 and it will be seen that this portion conforms to a portion of the collapsed area 71 of the first end portion 58 of member 56 and engages the upper portion of the area of the diamond shaped cut outs 64. Adhesive is applied between the hollow members 56 and 68 at the area identified by the reference numeral 71 and this adhesive not only serves to retain the second inner hollow member 68 within the confines of the outer hollow member 56, but it, also, serves to retain or keep the first end portion of the hollow member in its collapsed condition as shown in FIGS. 4 and 4D. It will be noted that this gives the cup a very decorative appearance and forms what will be referred to as a support engaging portion. This configuration will be referred to herein at times as a pedestal portion and will also be referred to as giving the cup a mug-shaped appearance.

Figure 6:
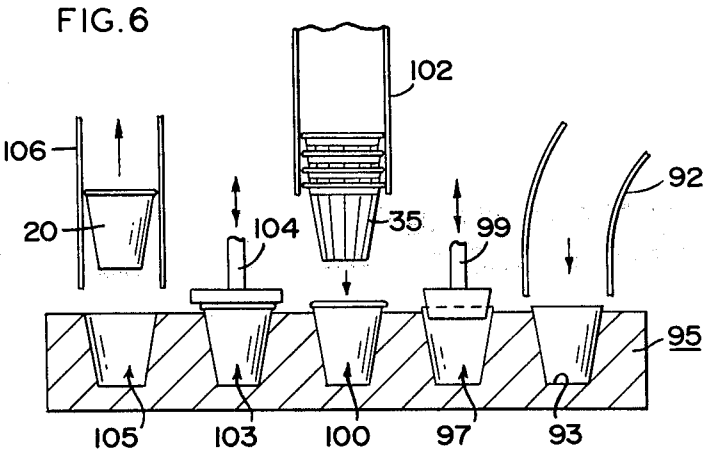
FIG. 6 is a view taken generally along the line 6—6 of FIG. 5.

FIGS. 5 and 6 are illustrations showing the apparatus and method for producing the cup of FIGS. 1 through 3 and FIG. 7 illustrates the apparatus and method for producing the cup shown in FIGS. 4 through 4D. We will first turn our attention to the embodiment shown in FIGS. 5 and 6.

FIG. 5 shows a rotatable turret 74 which carries a plurality of frustro-conically shaped forms or mandrels 76 which serve to form the outer hollow member 22 shown in FIG. 1. Another rotatable turret 77 is positioned adjacent turret 74 and carries a plurality of flap paper blanks 78. Adhesive 79 is applied to the blanks 78 at two of the marginal edges and when turrets 74 and 77 index to the station indicated by number 80, mechanical hands (not shown) wrap the blank 78 around one of the forms 76. The adhesive 79 causes the blanks 78 to maintain their frustro-conical shape. A punch 82 and die 83 are positioned adjacent turret 74 at a station identified at 85 and serve to punch a circular blank 84 of paper from a strip of paper 86 which serves to form the bottom wall 30 of the member 22 as shown in FIG. 1. The circular blank 84 of paper is held to the bottom of each form 76 by means of a vacuum system, the details of which have not been shown. Three stations of turret 74 after station 80 are for the purpose of finishing the bottom of blank 78 and the bottom wall 30 of member 22. Rotatable members 90 are located at these stations and serve to form or roll the bottom edge of blank 78 back upon itself to hold bottom wall 30 in place as shown in FIG. 1. At a final station hollow member 22 is ejected from its form 76 by means of an air blast and travels down a guide 92 to a cavity 93 in a third turret 95. Turret 95 is rotatable to various stations which will be described.

The first station is identified by the reference numeral 97 and at this station a reciprocably movable member 99 moves into and out of the upper end portion of hollow member 22 to apply an adhesive like glue to the upper portion for adhering a second hollow member 35 thereto. At the next station 100 the hollow member 22 is positioned beneath a tube 102 which serves to feed a continuous supply of hollow members 35. At this station a single hollow member 35 is dropped into hollow member 22. At the next station 103 a member 104 is moved into contact with the lip 45 of hollow member 35 so as to push the hollow member 35 into its final position in hollow member 22. At station 105 completed cup 20 is pneumatically ejected from turret 95 through a guide 160 to a storage place for the cups.

Figure 7:
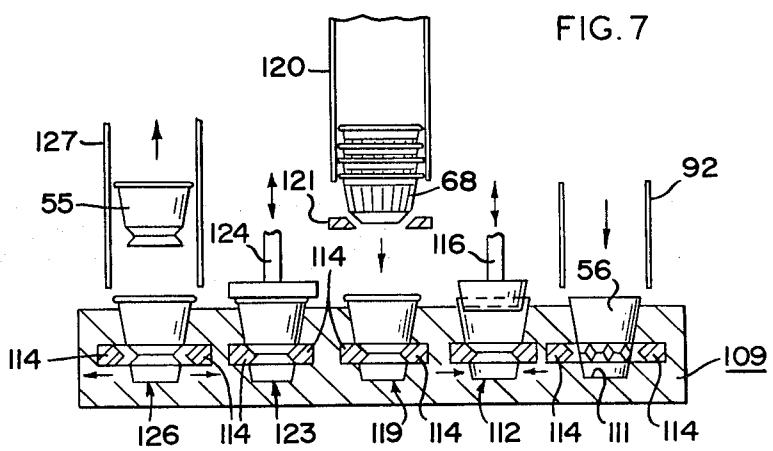
FIG. 7 is a view similar to FIG. 6 and showing an apparatus for making the cup shown in FIGS. 4 through 4D.

FIG. 7 is a view similar to FIG. 6 but illustrates an apparatus for producing the finished cup shown in FIG. 4. In this view there is illustrated a rotatable turret 109 with a plurality of cavities therein which cavities move to various stations as the turret 109 is rotated. Turrets exactly like turrets 74 and 77 in FIG. 5 are utilized to form the outer hollow member 56 and a blank like 62 shown in FIG. 4A is utilized which has a plurality of diamond-shaped cut outs applied thereto as shown in FIG. 4B. The blank shown in FIG. 4B is utilized in place of the blank 78 shown in FIG. 5. In other respects the operation and structure of the apparatus is the same and a completed outer hollow member 56 exits turret 74 through the guide 92, and, of course, the outer hollow member 56 which travels down guide 92 is of a configuration as shown in FIG. 4C. The outer hollow member 56 travels to cavity 111 in turret 109 where it is moved to a station 112. At station 112 mechanical collapsing members 114 are moved in a generally radial direction to collapse the lower end portion of the outer hollow member 56 at the diamond-shaped cut outs to produce a configuration as shown in FIG. 4D. A vertically movable member 116 is, also, utilized at this station for providing an adhesive, like glue to the inner surface of member 56. The member 56 then moves to station 119 where it is positioned immediately below a tube 120 which carries a continuous supply of the preformed plastic inner hollow member 6. A release mechanism (not shown) serves to release these members 68 one at a time so that they are dropped into the hollow member 56. Members 121 are for the purpose of applying glue to the bottom of members 68 so they are firmly attached to the hollow members 56 in the area of the diamond-shaped cut outs. At station 123 a force applying member 124 like member 104 is utilized to firmly press the hollow members 68 into the hollow members 56 and at station 126 the collapsing members 114 are released and the finished cup is pneumatically ejected from the turret 109 through a guide 127 like guide 106 to a final storage area.

It will, therefore, be apparent that the present disclosure describes a unique container construction which utilizes an outer hollow member of a paperboard construction and an inner hollow member of a synthetic plastic construction. These two constructions combine the advantages of both, and the combination offsets any of the disadvantages that may exist in the individual constructions. The container is extremely efficient and economical to manufacture and has exceptionally good insulation characteristics for use in containing either hot or cold liquids or solid materials.

The methods disclosed provide unique means for manufacturing both container constructions disclosed and it is apparent that a unique mug-shape container design has been disclosed which can be readily manufactured from a paperboard or similar material.

Although this invention has been described in its preferred form and preferred practice with a certain degree of particularity, it is understood that the present disclosure of the preferred form and preferred practice has been made only by way of example and that numerous changes in the details of construction and the combination and arrangement of parts and steps may be resorted to without departing from the spirit and the scope of the invention as hereinafter claimed.

We claim:

1. The method of making a double wall container including the steps of applying a first paper blank to the sides of a frustro-conically shaped form and a second paper blank to the smaller diameter end of the form and connecting the two blanks together to form the outer hollow member of the double wall container, applying a first adhesive to selected edges of said first paper blank to hold the outer hollow member in its formed shape, applying a second adhesive to the inner surface of the outer hollow member at an upper peripheral portion thereof by means of a member carrying adhesive and moved into the outer hollow member in a generally axial direction, inserting a preformed frustro-conically shaped hollow member formed of a synthetic plastic material into the outer hollow member to form the inner hollow member of the double wall container, exerting a force on the inner hollow member to press the same into place in the outer hollow member whereat it is held in place by said second adhesive.

2. The method of claim 1, wherein said force exerted on the inner hollow member is exerted by an axially movable member engageable with the inner hollow member at one end thereof.

3. The method of making a double wall container including the steps of applying a first paper blank to the sides of a frustro-conically shaped form and a second paper blank to the smaller diameter end of the form and connecting the two blanks together to form the outer hollow member of the double wall container, applying an adhesive to a portion of the inner surface of the outer hollow member, inserting a preformed frustro-conically shaped hollow member formed of a synthetic plastic material, which has an overturned lip portion, into the outer hollow member to form the inner hollow member of the double wall container, engaging said lip portion by an axially movable member and moving the axially movable member axially to press the inner hollow member into place in the outer hollow member whereat it is held in place by said adhesive.

4. The method of making a double wall container including the steps of making a first blank of such configuration that when assembled forms a cup-shaped configuration, producing a plurality of diamond-shaped cut outs in said blank with the longest dimension of said diamonds extending in an axial direction of the assembled blank and the shortest dimension of said diamonds extending in a circumferential direction of the assembled blank, applying said first blank to the sides of a form and a second paper blank to the smaller diameter end of the form and connecting the two blanks together to form the outer hollow member of the double wall container, radially collapsing the outer hollow member at the location of the diamond-shaped cut outs to form a support engaging portion and inserting a preformed cup-shaped hollow member into the outer hollow member to form the inner hollow member of the double wall container.

5. The method of claim 4, wherein both of the referred to cup-shapes are frustro-conical in configuration and glue is applied between the inner and outer hollow members.

6. The method of claim 5, wherein said adhesive which is applied between the outer and inner hollow members is applied at a place where the outer hollow member is radially collapsed and the inner hollow member engages this place which holds the inner hollow member in position and maintains the outer hollow member in its collapsed condition.

7. The method of claim 6, wherein said outer hollow member is of a paper material construction and said inner hollow member is of a synthetic plastic material construction.

* * * * *